US007376370B2

(12) United States Patent
Imada et al.

(10) Patent No.: US 7,376,370 B2
(45) Date of Patent: May 20, 2008

(54) IMAGE FORMING APPARATUS HAVING STABLE WEIGHT BALANCE

(75) Inventors: Takanoshin Imada, Saitama (JP); Yuichi Fujisawa, Saitama (JP); Masashi Sudo, Saitama (JP); Junichi Yumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 322 days.

(21) Appl. No.: 11/217,574

(22) Filed: Sep. 2, 2005

(65) Prior Publication Data

US 2006/0182463 A1 Aug. 17, 2006

(30) Foreign Application Priority Data

Feb. 15, 2005 (JP) ..... 2005-037599

(51) Int. Cl.
*G03G 15/00* (2006.01)

(52) U.S. Cl. ..... 399/107; 399/119; 399/227

(58) Field of Classification Search ..... 399/107, 399/119, 222, 226, 227
See application file for complete search history.

(56) References Cited

U.S. PATENT DOCUMENTS 5,887,227 A * 3/1999 Kawai et al. ..... 399/98
6,178,301 B1 * 1/2001 Kojima et al. ..... 399/98
6,336,020 B1 * 1/2002 Ishikawa et al. ..... 399/227
2005/0002702 A1 1/2005 Nakatomi

FOREIGN PATENT DOCUMENTS

| | | | |
|---|---|---|---|
| CN | 1577138 | A | 2/2005 |
| JP | 11-295961 | A | 10/1999 |
| JP | 2000-224360 | A | 8/2000 |
| JP | 2001-034141 | A | 2/2001 |
| JP | 2001-34141 | A | 2/2001 |
| KR | 2004-0085184 | A | 10/2004 |

* cited by examiner

*Primary Examiner*—Hoan Tran
(74) *Attorney, Agent, or Firm*—Sughrue Mion, PLLC

(57) ABSTRACT

An image forming apparatus includes a rotary type developing device having multiple developers provided so as to be rotatable; an image forming unit including the rotary type developing device disposed therein; an image reading unit disposed above the image forming unit; and supporting members for supporting the image reading unit movably. The center of gravity of the rotary type developing device is located toward one side with respect to the center position of the image forming unit, and the center of gravity of the image reading unit moves to the other side as the image reading unit supported by the supporting members is moved.

20 Claims, 8 Drawing Sheets

RELATED ART

IMAGE FORMING APPARATUS HAVING STABLE WEIGHT BALANCE

CROSS-REFERENCE TO RELATED APPLICATION

This application claims priority under 35 USC 119 from Japanese Patent Application No. 2005-37599, the disclosure of which is incorporated by reference herein.

BACKGROUND OF THE INVENTION

1. Field of the Invention

The present invention relates to an image forming apparatus.

2. Description of the Related Art

An image forming apparatus having a rotary type developing device which includes multiple developers, and in which a developer is rotated to a development position of a photosensitive body to develop a latent image formed on the photosensitive body so as to form a toner image on the photosensitive body is well known (see Japanese Patent Application Laid-Open (JP-A) No. 11-295961).

Further, a structure of an image forming apparatus having an image reading unit (scanner) in which the entire image reading unit moves and retreats in order to exchange a cartridge is also well known (see, for example, JP-A Nos. 2000-224360 and 2001-034141).

FIG. 8 schematically shows an image forming apparatus 1000 having a rotary type developing device 802 in which an image reading unit 900 (scanner) is disposed at an interval to the top face of an image forming unit 800 as described in JP-A No. 11-295961. In this image forming apparatus 1000, the image reading unit 900 rotates for exchange of a cartridge (not shown) and maintenance so that it retreats from above the front side of the image forming unit 800. Meanwhile, the front side refers to the side at which a user makes operations, and the opposite side to the front side is called the rear side.

The rotary type developing device 802 is very heavy because it includes multiple developers (not shown) each having a development roll (not shown) containing a magnet roll and a toner cartridge (not shown) accommodating toner. Further, the image reading unit 900 is also very heavy because it has a manuscript base (not shown) made of thick platen glass or the like.

The center of gravity of the rotary type developing device 802 is located toward the rear side (to the left side in the drawing) of the center line X of the image forming unit 800, as indicated by a dot line Y. The center of gravity of the image reading unit 900 is also located toward the rear side of the center line X of the image forming unit 800. That is, because the centers of gravity of the rotary type developing device 802 and the image reading unit 900 are inclined toward the rear side, the overall weight balance of the image forming apparatus 1000 is poor.

Further, because the center of gravity of the image reading unit 900 moves from a dot line Z1 to a dot line Z2 as the image reading unit 900 rotates, it moves further to the rear side. That is, the rotation of the image reading unit 900 worsens the weight balance further. As a consequence, the image forming apparatus 1000 becomes unstable.

Additionally, because a force is applied in a direction of pushing the image reading unit 900 to the rear side when the image reading unit 900 is rotated (see the arrow Z in the drawing), the image forming apparatus becomes further unstable.

SUMMARY OF THE INVENTION

The present invention has been accomplished to solve the above-mentioned problems and provides an image forming apparatus which is stable in that the center of gravity thereof is not unbalanced.

According to a first aspect of the invention, an image forming apparatus is provided that includes: a rotary type developing device having multiple developers for forming a toner image on a photosensitive body by developing a latent image formed on the photosensitive body, and provided so as to be rotatable; an image forming unit including the rotary type developing device disposed therein; an image reading unit disposed above the image forming unit; and supporting members for supporting the image reading unit movably, wherein the center of gravity of the rotary type developing device is located toward one side with respect to the center position of the image forming unit, and the center of gravity of the image reading unit moves to the other side as the image reading unit supported by the supporting members is moved.

In the image forming apparatus of the first aspect of the invention, the image reading unit disposed above the image forming unit is moved and, for example, a replaceable component such as a cartridge can be replaced. The center of gravity of the rotary type developing device is located toward one side with respect to the center position of the image forming unit. Further, the center of gravity of the image reading unit moves toward the other side.

Thus, the center of gravity is never inclined to one side or the other side such that the image forming apparatus becomes unstable due to the moving of the image reading unit.

According to a second aspect of the invention, an image forming apparatus is provided that includes: a rotary type developing device having multiple developers for forming a toner image on a photosensitive body by developing a latent image formed on the photosensitive body, and provided so as to be rotatable; an image forming unit including the rotary type developing device disposed therein; an image reading unit disposed above the image forming unit; and supporting members for supporting the image reading unit movably, wherein the center of rotation of the rotary type developing device is located toward one side with respect to the center position of the image forming unit and the center of gravity of the image reading unit moves toward the other side as the image reading unit supported by the supporting members is moved.

In the image forming apparatus of the second aspect of the invention, the image reading unit disposed above the image forming unit is moved and, for example, a replaceable component such as a cartridge can be replaced. The center of rotation of the rotary type developing device is located toward one side with respect to the center position of the image forming unit. In the rotary type developing device, the center of gravity oscillates as it rotates. However, the center of the deflection of the center of gravity is a rotation center. The center of gravity of the image reading unit moves toward the other side.

Therefore, as the image reading unit is moved, the center of gravity is never inclined to one side or the other side such that the image forming apparatus becomes unstable. Further, the influence of the deflection of the center of gravity due to the rotation of the rotary type developing device is minimal.

BRIEF DESCRIPTION OF THE DRAWINGS

Preferred embodiments of the present invention will be described in detail based on the following figures, wherein.

DETAILED DESCRIPTION OF THE INVENTION

Figure 1:
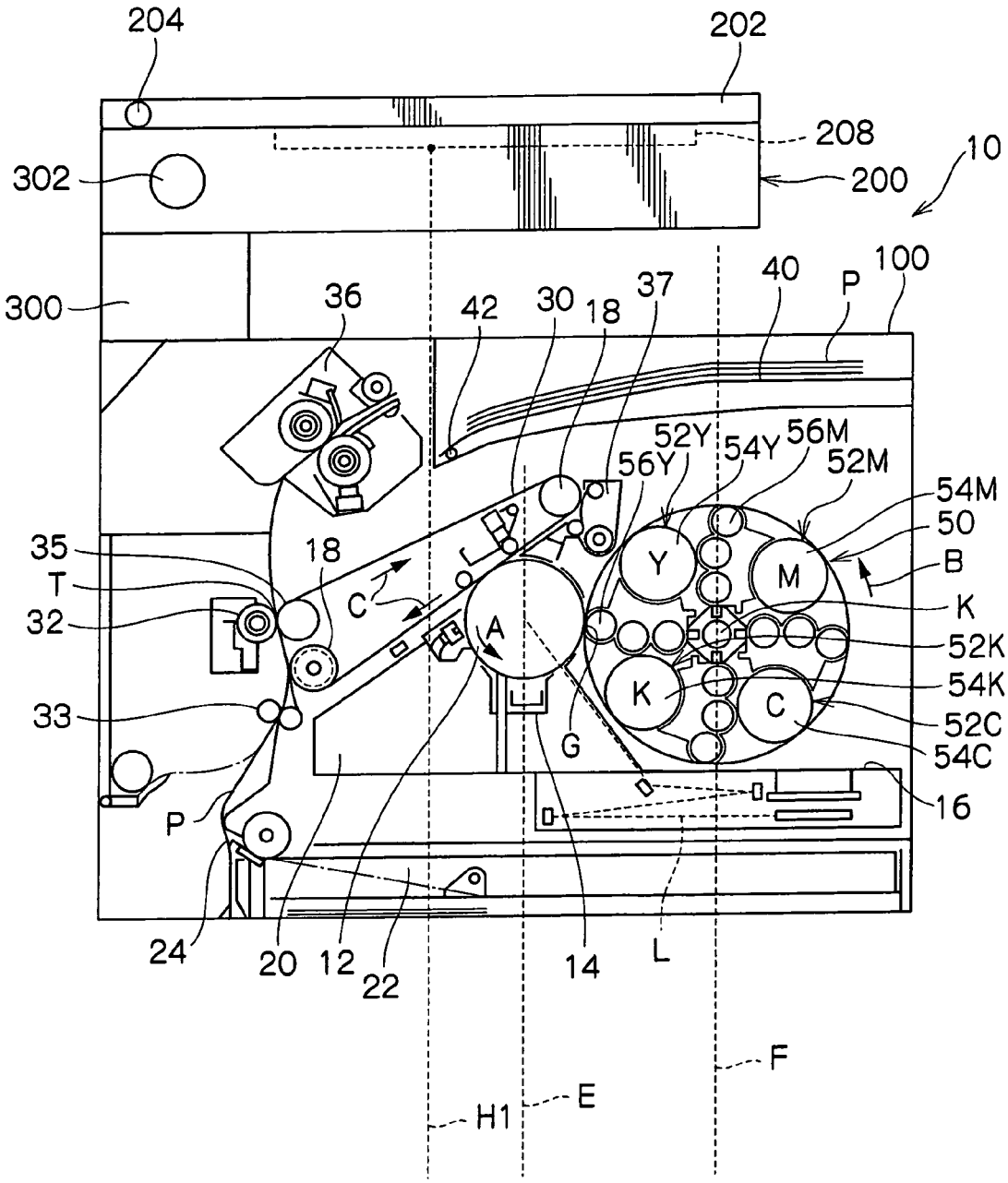
FIG. 1 is a drawing schematically showing a digital copier according to an embodiment of the present invention.

FIG. 1 shows a schematic structure of a digital copier 10 as an example of an image forming apparatus according to an embodiment of the present invention.

In the digital copier 10, an image reading unit 200 is disposed at an interval to the top face of an image forming unit 100. The image reading unit 200 reads a manuscript and converts the information to digital image data. The image forming unit 100 forms a full color image on a recording paper P using color toners of magenta (M), yellow (Y), cyan (C) and black (K) based on digital image data read by the image reading unit 200.

In the following, when respective components need to be distinguished for each color, any one of Y, M, C and K is attached after the reference numeral concerned (for example, developer 52Y). The right side of each drawing is the front side of the digital copier 10 at which a user conducts various operations and the left side is the rear side.

First, the image reading unit 200 will be described.

Figure 3:
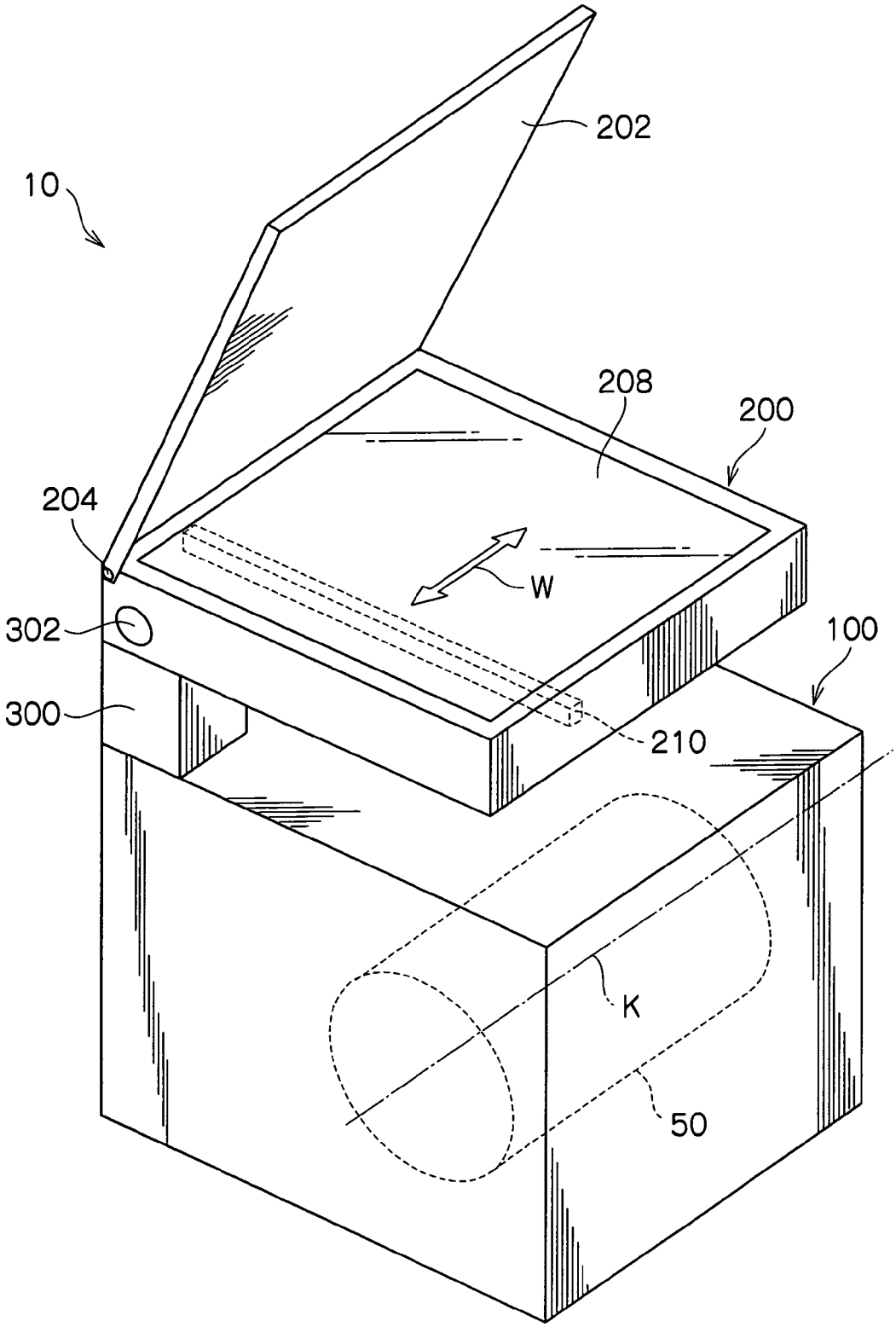
FIG. 3 is a perspective view schematically showing a state in which the pressing plate of the image reading unit of the digital copier is opened.

As shown in FIGS. 1 and 3, the image reading unit 200 is substantially rectangular and two corner portions thereof are mounted on two columns 300 erected on the rear side end portion of the image forming apparatus 100.

Figure 2:
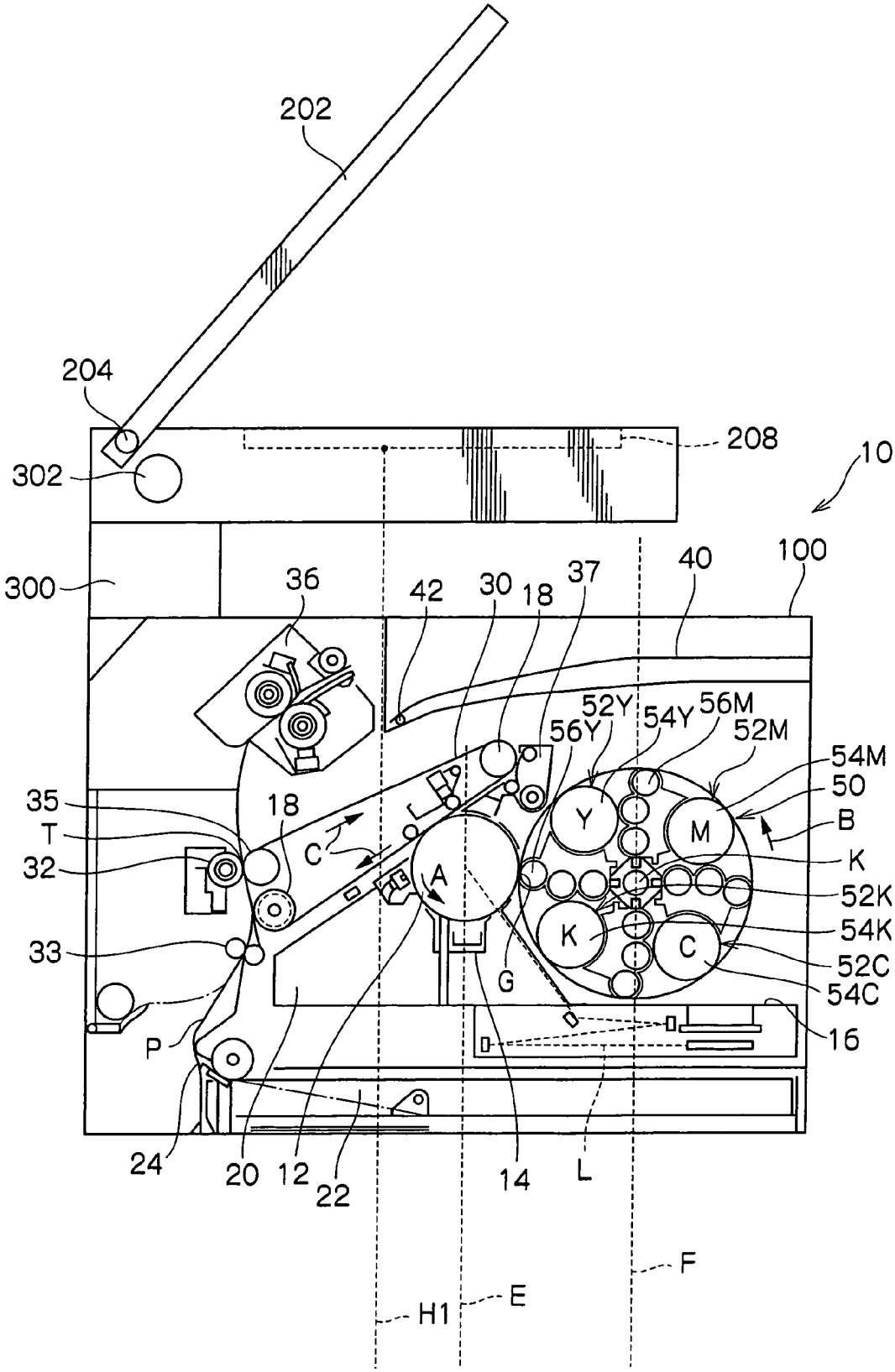
FIG. 2 is a drawing schematically showing a state in which a pressing plate of the image reading unit of the digital copier shown in FIG. 1 is opened.

As shown in FIGS. 2 and 3, the pressing plate 202 of the image reading unit 200 is rotated around a rotation shaft 204 on the rear side to open it. A transparent manuscript base 208 made of platen glass or the like on which a manuscript is loaded is provided below the pressing plate 202. Then, after a manuscript is loaded on the manuscript base 208 by opening the pressing plate 202, the pressing plate 202 is closed so that the manuscript is sandwiched between the pressing plate 202 and the manuscript base 208.

As shown in FIG. 3, a reading bar 210 made of CCD or the like for reading a manuscript loaded on the manuscript base 208 is provided below the manuscript base 208. The reading bar 210 is elongated from the front side to the rear side, and scans in the direction of an arrow W to read an image of the manuscript loaded on the manuscript base 208.

Figure 4:
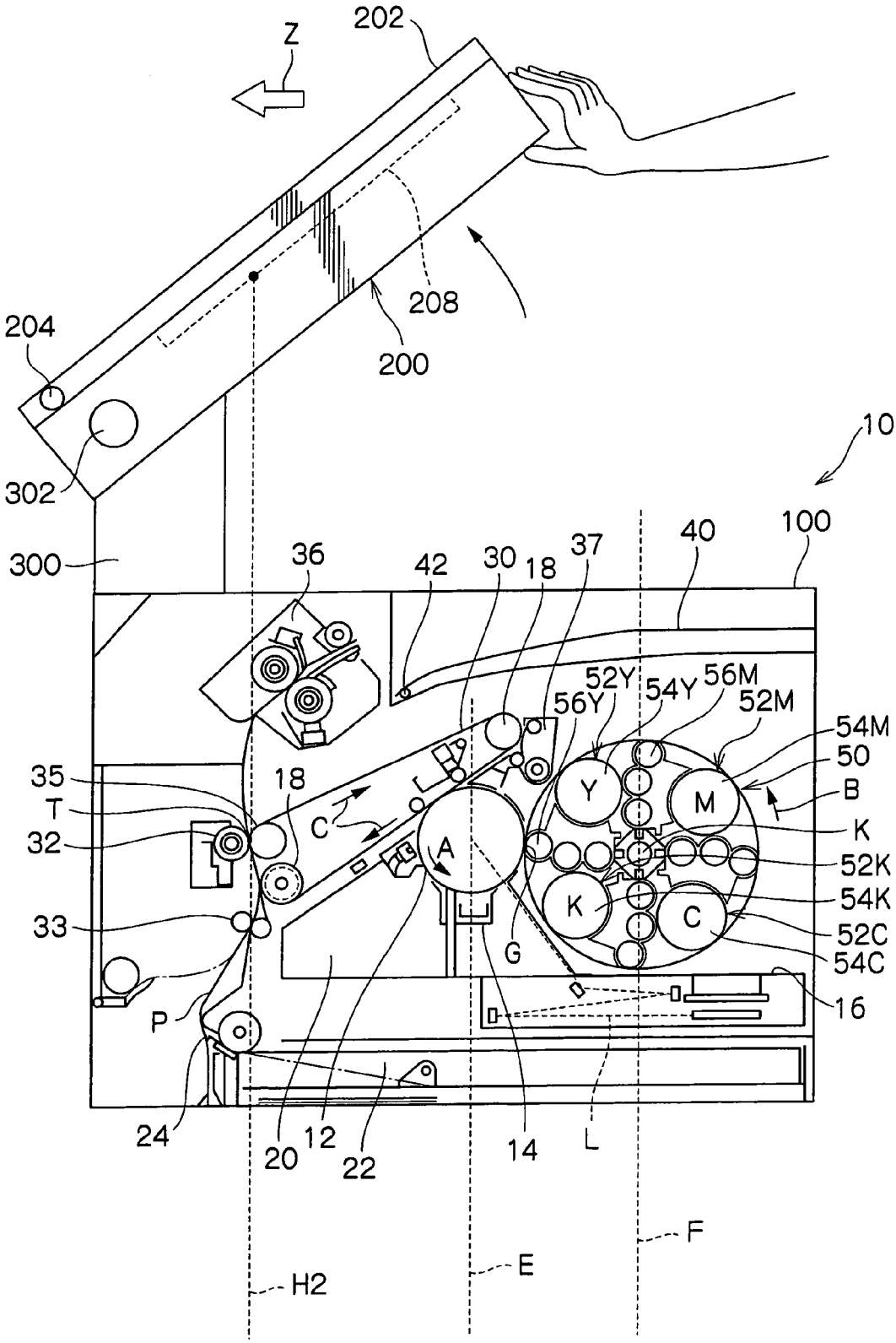
FIG. 4 is a drawing schematically showing a state in which the entire image reading unit of the digital copier shown in FIG. 1 is rotated.

As shown in FIG. 4, the entire image reading unit 200 is rotated around the rotation shaft 302 of the columns 300 from a substantially horizontal state to an open state. When the entire image reading unit 200 is rotated, it retreats from above the front side of the image forming unit 100 so that space is formed above the front side.

Next, an outline of the configuration of the image forming unit 100 and an outline of the process of forming a color image on a recording paper P will be described.

As shown in FIG. 1, a photosensitive drum 12 is disposed substantially in the center of the image forming unit 100 such that it is rotatable. A rotary type developing device 50 is disposed at the front side (right side) of the image forming unit 100.

The photosensitive drum 12 rotates in the direction of an arrow A. The surface of the photosensitive drum 12 is charged with a predetermined potential by a charger 14 disposed below the photosensitive drum 12. After that, the surface is exposed to light with laser beam L emitted from an optical scanning unit 16 disposed below the photosensitive drum 12 and a latent image based on digital image data from the manuscript read by the image reading unit 200 is formed.

The latent image formed on the surface of the photosensitive drum 12 is disposed along a circumferential direction of the rotary type developing device 50 and developed with developers 52Y, 52M, 52C, 52K of the colors magenta (M), yellow (Y), cyan (C) and black (K), respectively, so as to form a specified colored toner image. Further, the respective developers 52Y, 52M, 52C, 52K have replaceable toner cartridges 54Y, 54M, 54C, 54K.

A toner image formed on the surface of the photosensitive drum 12 is transferred primarily to an intermediate transfer belt 30 stretched by plural rolls 18 and transfer roll 35 and rotating in the direction of an arrow C. Non-transferred residual toner left on the surface of the photosensitive drum 12 without being transferred primarily is removed by a photosensitive drum cleaning unit 20.

The rotary type developing device 50 rotates around a rotation shaft K in the direction of an arrow B, so that developing rollers 56Y, 56M, 56C and 56K of developers 52Y, 52M, 52C, 52K of a color corresponding to a color of an image to be formed are moved to a development position G successively so as to develop each color. As shown in FIG. 3, the rotation shaft K of the rotary type developing device 50 is parallel to a scanning direction (direction of the arrow W) of the reading bar 210 of the image reading unit 200. Further, the rotation shaft K is also parallel to the rotation shaft 302 of the columns 300 of the image reading unit 200.

Respective steps of charging, exposure to light, development, primary transfer and photosensitive drum cleaning are repeated at a specified frequency corresponding to the color of an image to be formed.

In this way, the respective toner images are transferred to and overlaid on the intermediate transfer belt 30 to form a full-color image.

On the other hand, a paper feeding cassette 22 in which recording papers P are accommodated is disposed at the bottom of the image forming unit 100.

A recording paper P is sent out by a paper feed roller 24 and carried to a secondary transfer position T at a predetermined timing by a resist roller 33, so that the full-color toner image on the intermediate transfer belt 30 is totally transferred secondarily to the recording paper P by a secondary transfer roll 32 and the transfer roll 35. Non-transferred residual toner left on the intermediate transfer belt 30 without being transferred secondarily is removed by a transfer belt cleaning unit 37.

The recording paper P, after the full-color toner image is transferred, is sent to a fixing device 36 disposed on the upper rear side. The fixing device 36 fixes the full-color toner image on the recording paper P with heat and pressure. After the full-color toner image is fixed, the recording paper P is discharged to a discharged paper tray 40 located at an upper portion of the image forming unit 100.

The secondary transfer position T is located on the rear side of the image forming unit 100 and the recording paper P is carried from below to above and the full-color toner image is transferred at the secondary transfer position T and then, the paper P is discharged from the rear side to the front side.

Figure 5:
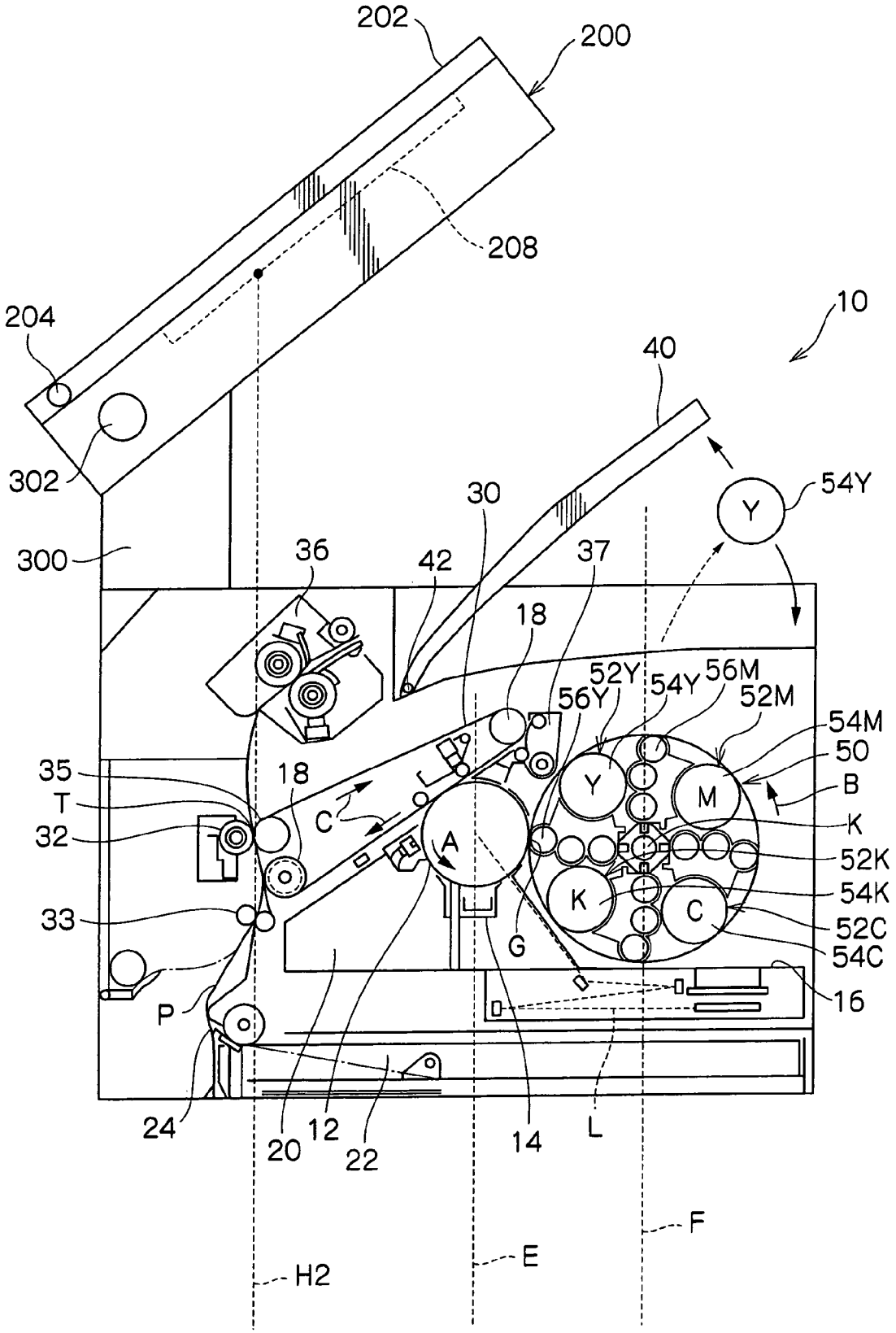
FIG. 5 is a drawing schematically showing a state in which when the entire image reading unit of the digital copier shown in FIG. 4 is rotated, the discharge paper tray is opened for exchange of a toner cartridge.

Then, if the image reading unit 200 is retracted from above the front side of the image forming unit 100 by rotating the entire image reading unit 200 as shown in FIG. 4, space is created above the front side of the image forming unit 100. If the discharged paper tray 40 is opened by rotating it around a rotation shaft 42 at a rear side end portion thereof as shown in FIG. 5, a toner cartridge 54 can be replaced. FIG. 5 shows the replacement of the toner cartridge 54Y and when other toner cartridges 54M, 54C, 54K are to be replaced, each developer 52 is moved to a replaceable position by rotating the rotary type developing device 50.

Although this embodiment has described an example of the rotary type developing device 50 having the four developers 52Y, 52M, 52C, 52K, the invention is not restricted to this example, but is also applicable to a rotary type developing device having two or more developers.

Next, the operation of this embodiment will be described.

The rotary type developing device 50 is very heavy because it includes a toner cartridge 54 filled with toner, a developing roll 56 accommodating a magnet roll and the like. Further, the image reading unit 200 is also very heavy because it has a manuscript base 208 made of thick platen glass or the like.

Figure 6:
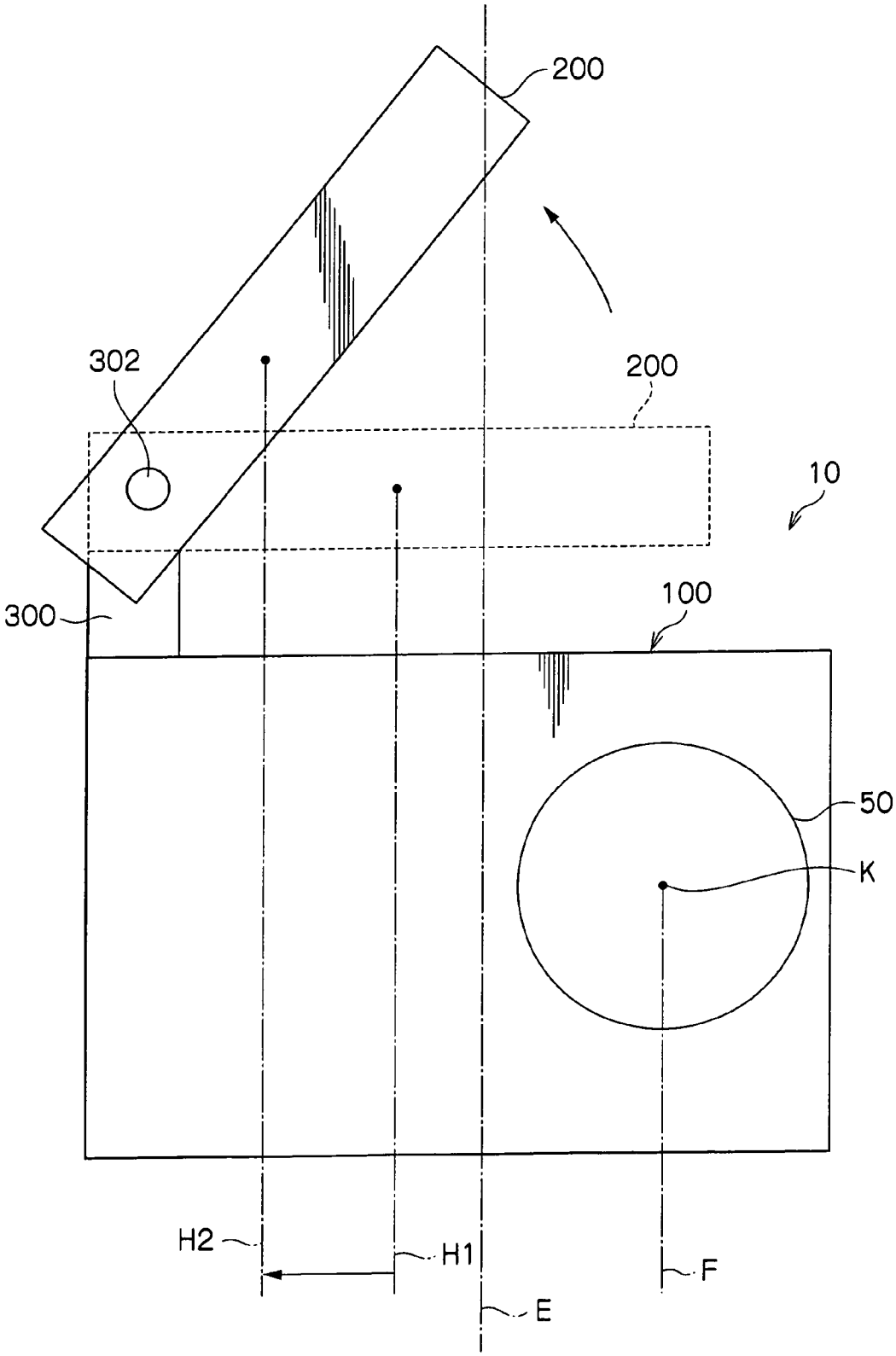
FIG. 6 is a diagram explaining the center of gravity of the rotary type developing device and the center of gravity of the image reading unit.

FIG. 6 schematically shows the digital copier 10. A dot line F indicating the center of gravity of the rotary type developing device 50 is located toward the front side with respect to a center line E of the image forming unit 100. A dot line H1 indicating the center of gravity of the image reading unit 200 is located toward the rear side with respect to the center line E of the image forming unit 100. That is, the centers of gravity of the heavy rotary type developing device 50 and image reading unit 200 are distributed between the front side and rear side. Because the centers of gravity are not biased toward either the front side or the other side, the weight balance of the digital copier 10 is excellent so that it has excellent stability. Further, the center of gravity of the rotary type developing device 50 substantially coincides with the rotation shaft K.

Further, the center of gravity of the image reading unit 200 moves further to the rear side toward a dot line H2 as the image reading unit 200 is rotated. Thus, the center of gravity is never inclined so that instability occurs due to the rotation of the image reading unit 200. Although a force of pushing the image reading unit 200 to the rear side (see the arrow Z in the drawing) is applied as shown in FIG. 4, the stability is secured because the weight balance is excellent.

Since, as shown in FIG. 3, the scanning direction of the reading bar 210 is perpendicular to the moving direction of the center of gravity of the image reading unit 200, the weight balance is not changed by the scanning of the reading bar 210.

Since, as shown in FIG. 4, the image reading unit 200 is opened from the front side to the rear side, a user can open the image reading unit 200 easily. Further, because space is created above the front side of the image forming unit 100 as described above, a user can replace the toner cartridge 54 from the front side (operation side) easily as shown in FIG. 5.

Because the discharged paper tray 40 is provided above the image forming unit 100, the image reading unit 200 is disposed at a high position. The center of gravity of the image reading unit 200 is raised because of the rotation. Although instability is likely to occur when the center of gravity is high, stability is maintained because the weight balance is excellent as described above.

The recording paper P is carried from below to above and after a full-color toner image is transferred at the secondary transfer position T, it is discharged to the front side from the rear side. Thus, it is easy to take the recording paper P out from the front side. Further, by rotating the image reading unit 200, the recording paper P can be taken out easily.

The invention is not restricted to the above described embodiments.

Although according to the above embodiment an object of retracting the image reading unit 200 from above the image forming unit 100 by rotating the image reading unit 200 is to replace the toner cartridge 54, the invention is not restricted to this example. The image reading unit 200 may be rotated for other objects. For example, the object may be to replace the photosensitive drum 12 or to execute jamming countermeasures for removing a jammed recording paper P. Alternatively, the object may be for other maintenance work.

Figure 7:
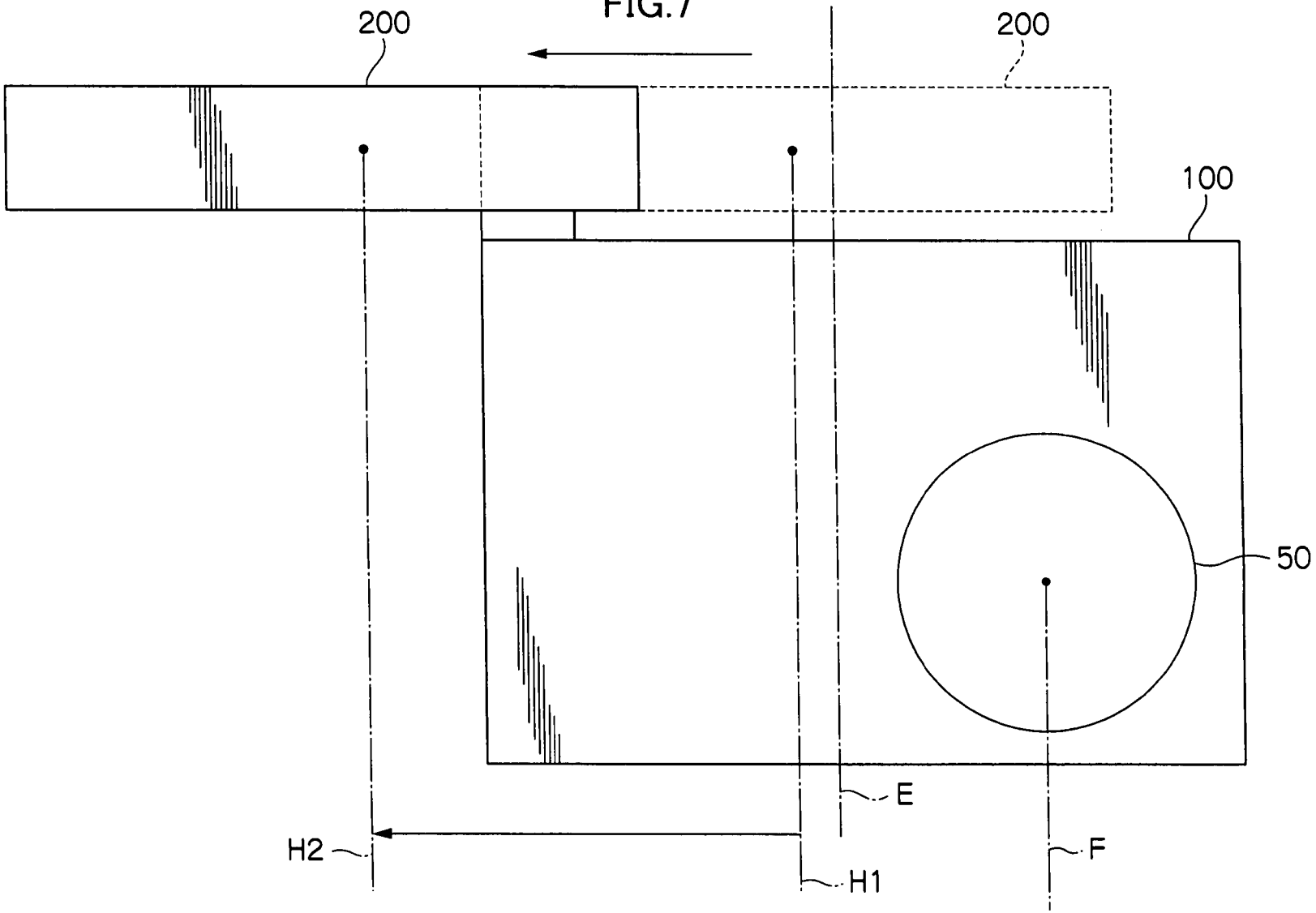
FIG. 7 is a diagram schematically showing a digital copier according to another embodiment of the invention.
Figure 8:
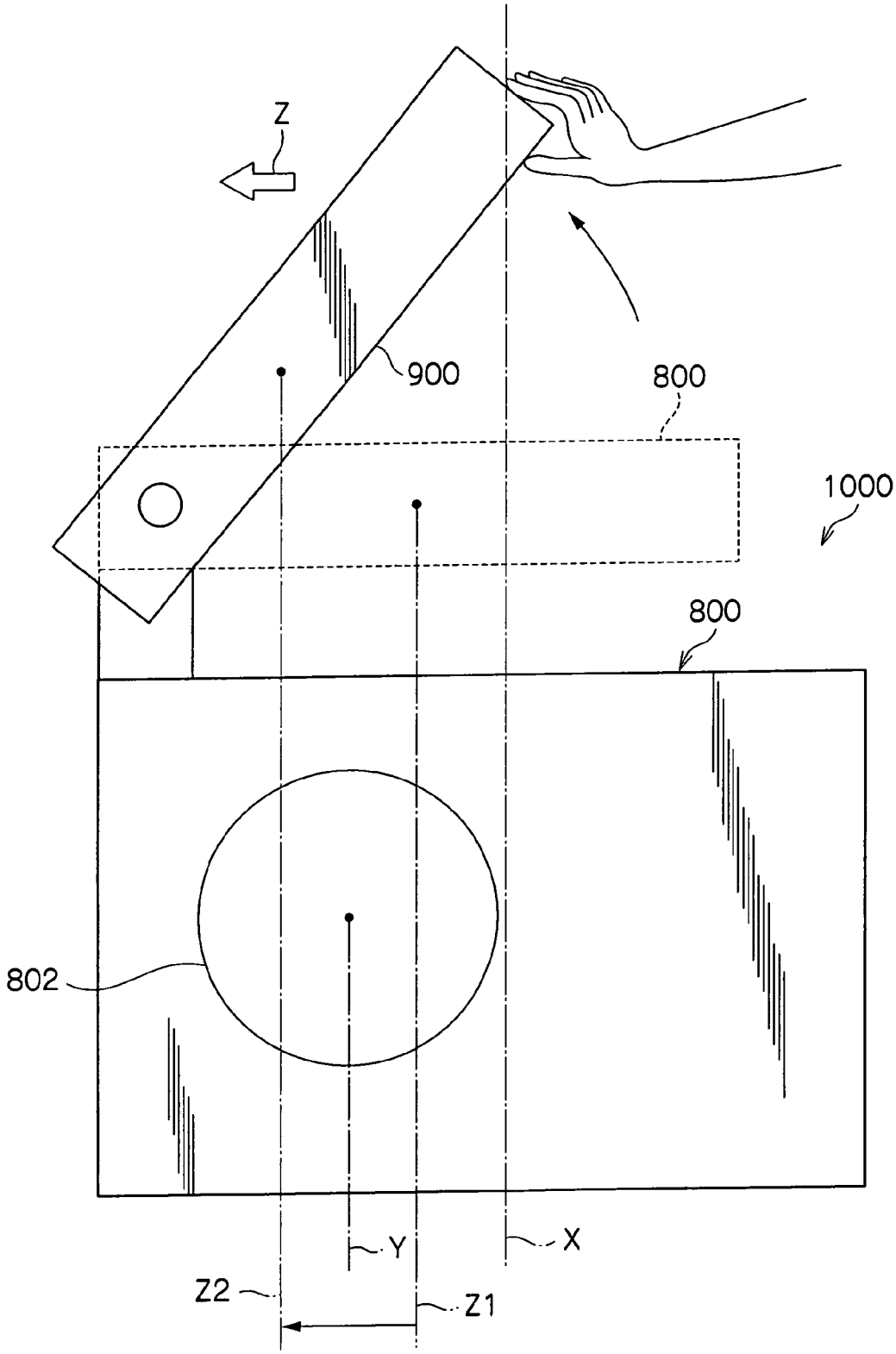
FIG. 8 is a diagram showing an example of the digital copier which becomes unstable when the image reading unit is moved.

Although according to the above embodiment, as shown in FIG. 6, the image reading unit 200 is retracted from above the image forming unit 100 by rotating the image reading unit 200, the invention is not restricted to this example. For example, as shown in FIG. 7, the image reading unit 200 may be slid to the rear side from the front side (see the construction of FIG. 5 of JP-A No. 2001-034141).

Although the present invention has been explained in terms of particular embodiments thereof, the invention should not be interpreted as being restricted to these embodiments.

That is, the image forming apparatus of the first aspect of the invention includes a rotary type developing device having multiple developers for forming a toner image on a photosensitive body by developing a latent image formed on the photosensitive body, which is provided so as to be rotatable; an image forming unit including the rotary type developing device disposed therein; an image reading unit disposed above the image forming unit; and supporting members for supporting the image reading unit movably, wherein the center of gravity of the rotary type developing device is located toward one side with respect to the center position of the image forming unit and the center of gravity of the image reading unit moves to the other side as the image reading unit supported by the supporting members is moved.

In the image forming apparatus of the first aspect, the supporting members may have a rotation shaft for supporting the image reading unit rotatably and the rotation shaft may extend in the same direction as the rotation shaft of the rotary type developing device.

With the above-described structure, the image reading unit can be rotated by the rotation shaft in the supporting portion extending in the same direction as the rotation shaft of the rotary type developing device.

Due to this rotation, the center of gravity of the image reading unit moves upward to a higher position, so that it is removed from the rotation type developing unit. That is, although instability likely occurs as the image reading unit rotates, the center of gravity is never inclined to one side or the other side, thereby maintaining the stability of the image forming apparatus.

In the image forming apparatus of the first aspect, a recording medium discharge portion may be disposed between the image reading unit and the image forming unit.

According to the above-described structure, the image reading unit is disposed at a high position whereby the recording medium discharging portion is sandwiched by the image reading unit and the image forming unit, so that it is likely to be unstable. However, the center of gravity is never inclined to only one side or the other, thereby maintaining the stability of the image forming apparatus.

In the image forming apparatus of the first aspect, assuming that the one side is the front side while the other side is the rear side, the center of gravity of the rotary type developing device may be located toward the front side with respect to the center of gravity of the image reading unit.

According to the above-described structure, the center of gravity of the rotary type developing device is located toward the front side of the image forming apparatus with respect to the center position of the image forming unit. Further, the center of gravity of the image reading unit is moved by a moving member toward the rear side of the image forming apparatus. Further, the center of gravity of the rotary type developing device is located further toward the front side than the center of gravity of the image reading unit.

That is, the center of gravity of the rotary type developing device is located toward the front side and the center of gravity of the image reading unit is located toward the rear side with respect to the center of gravity of the rotary type developing device. Further, the center of gravity of the image reading unit is moved by the moving member further toward the rear side. That is, the center of gravity of the image reading unit is removed from the center of gravity of the rotary type developing device as it is moved. Thus, the respective centers of gravity thereof are arranged with an excellent balance.

The front side refers to a side at which a user performs various operations of the image forming apparatus and the rear side refers to an opposite side to the front side. Because the image reading unit moves from the front side (operation side) to the rear side, a user can move the image reading unit easily. Further, because space is created at the front side due to the moving of the image reading unit, a cartridge, for example, can be replaced easily.

In the image forming apparatus of the first aspect, a toner image formed on the photosensitive body may be transferred to an intermediate transfer body and the toner image transferred to the intermediate transfer body may be transferred to a recording medium conveyed from below to above and when one side is designated as the front side while the other side is designated as the rear side, the rotary type developing device may be disposed toward the front side such that the intermediate transfer body is sandwiched between the rotary type developing apparatus and the transfer position for transferring the toner image to the recording medium.

With such a structure, the rotary type developing device is disposed toward the front side and the intermediate transfer body is sandwiched between it and the transfer position for transferring a toner image to a recording medium conveyed from below to above. In other words, the recording medium is conveyed from below to above on the rear side on the other side of the intermediate transfer body with respect to the rotary type developing device, so that a toner image is transferred.

Therefore, it is possible to provide a structure wherein at the top of the image forming unit the recording medium is discharged from the rear side to the front side. Thus, the discharged recording medium can be taken out easily by a user.

In the image forming apparatus of the first aspect, the image reading unit may include a manuscript base and a reading member for reading the manuscript loaded on the manuscript base, and the scanning direction of the reading member may be perpendicular to the moving direction of the center of gravity of the image reading unit.

Since according to the above described structure, the center of gravity of the image reading unit is not changed (moved) by scanning of the reading member, the weight balance is not changed thereby.

According to a second aspect of the invention, an image forming apparatus is provided which includes a rotary type developing device having multiple developers for forming a toner image on a photosensitive body by developing a latent image formed on the photosensitive body, which is provided so as to be rotatable; an image forming unit including the rotary type developing device disposed therein; an image reading unit disposed above the image forming unit; and supporting members for supporting the image reading unit movably, wherein the center of rotation of the rotary type developing device is located toward one side with respect to the center position of the image forming unit and the center of gravity of the image reading unit moves toward the other side when the image reading unit supported by the supporting members is moved.

According to the invention, as described above, the center of gravity is never inclined only to one side or the other side when the image reading unit is moved. Therefore, the image forming apparatus remains stable.

What is claimed is:

1. An image forming apparatus comprising:

a rotary type developing device having a plurality of developers for forming a toner image on a photosensitive body by developing a latent image formed on the photosensitive body, and provided so as to be rotatable;

an image forming unit including the rotary type developing device disposed therein;

an image reading unit disposed above the image forming unit; and supporting members for supporting the image reading unit movably, wherein the center of gravity of the rotary type developing device is located toward one side with respect to the center position of the image forming unit, and the center of gravity of the image reading unit moves toward an other side as the image reading unit supported by the supporting members is moved.

2. The image forming apparatus of claim 1 wherein the supporting members have a rotation shaft for supporting the image reading unit rotatably and the rotation shaft extends in the same direction as a rotation shaft of the rotary type developing device.

3. The image forming apparatus of claim 1 wherein the supporting members have moving members for supporting the image reading unit slidably, wherein, when the one side is designated as a front side and the other side is designated as a rear side, the image reading unit slides from the front side to the rear side.

4. The image forming apparatus of claim 1 wherein a recording medium discharge portion is disposed between the image reading unit and the image forming unit.

5. The image forming apparatus of claim 1 wherein the one side is a front side and the other side is a rear side, and the center of gravity of the rotary type developing device is located toward the front side with respect to the center of gravity of the image reading unit.

6. The image forming apparatus of claim 1 wherein a toner image formed on the photosensitive body is transferred to an intermediate transfer body and the toner image transferred to the intermediate transfer body is transferred to a recording medium conveyed from below to above, and when the one side is designated as a front side and the other side is designated as a rear side, the rotary type developing device is disposed toward the front side with respect to a transfer position for transferring the toner image to the recording medium, and the intermediate transfer body is disposed therebetween.

7. The image forming apparatus of claim 1 wherein the image reading unit comprises:

a manuscript base;

a reading member for reading a manuscript loaded on the manuscript base; and a scanning direction of the reading member is perpendicular to a moving direction of the center of gravity of the image reading unit.

8. An image forming apparatus comprising:

a rotary type developing device having a plurality of developers for forming a toner image on a photosensitive body by developing a latent image formed on the photosensitive body, and provided so as to be rotatable;

an image forming unit including the rotary type developing device disposed therein;

an image reading unit disposed above the image forming unit; and supporting members for supporting the image reading unit movably, wherein the center of rotation of the rotary type developing device is located toward one side with respect to the center position of the image forming unit, and the center of gravity of the image reading unit moves toward an other side as the image reading unit supported by the supporting members is moved.

9. The image forming apparatus of claim 8 wherein the supporting members have a rotation shaft for supporting the image reading unit rotatably and the rotation shaft extends in the same direction as a rotation shaft of the rotary type developing device.

10. The image forming apparatus of claim 8 wherein the supporting members have moving members for supporting the image reading unit slidably, wherein when the one side is designated as a front side and the other side is designated as a rear side, the image reading unit slides from the front side to the rear side.

11. The image forming apparatus of claim 8 wherein a recording medium discharge portion is disposed between the image reading unit and the image forming unit.

12. The image forming apparatus of claim 8 wherein the one side is a front side and the other side is a rear side, and the center of rotation of the rotary type developing device is located toward the front side with respect to the center of gravity of the image reading unit.

13. The image forming apparatus of claim 8 wherein a toner image formed on the photosensitive body is transferred to an intermediate transfer body, and the toner image transferred to the intermediate transfer body is transferred to a recording medium conveyed from below to above, and when the one side is designated as a front side and the other side is designated as a rear side, and the rotary type developing device is disposed toward the front side with respect to a transfer position for transferring the toner image to the recording medium, and the intermediate transfer body is disposed therebetween.

14. The image forming apparatus of claim 8 wherein the image reading unit comprises: a manuscript base;

a reading member for reading a manuscript loaded on the manuscript base; and a scanning direction of the reading member is perpendicular to a moving direction of the center of gravity of the image reading unit.

15. An image forming apparatus comprising:

a rotary type developing device having a plurality of developers for forming a toner image on a photosensitive body by developing a latent image formed on the photosensitive body, and provided so as to be rotatable;

an image forming unit including the rotary type developing device disposed therein;

an image reading unit disposed above the image forming unit; and supporting members for supporting the image reading unit movably, wherein the center of gravity of the rotary type developing device is located toward one side with respect to the center position of the image forming unit; and the image reading unit is movable from a first state enabling reading to a second state disabling reading, and wherein in the first state, the center of gravity of the image reading unit is located toward an other side with respect to the center position of the image forming unit, and in the second state, the center of gravity of the image reading unit moves further toward the other side with respect to the center position of the image forming unit.

16. The image forming apparatus of claim 15 wherein the supporting members have a rotation shaft for supporting the image reading unit rotatably and the rotation shaft extends in the same direction as a rotation shaft of the rotary type developing device.

17. The image forming apparatus of claim 15 wherein a recording medium discharge portion is disposed between the image reading unit and the image forming unit.

18. The image forming apparatus of claim 15 wherein the one side is a front side and the other side is a rear side, and the center of gravity of the rotary type developing device is located toward the front side with respect to the center of gravity of the image reading unit.

19. The image forming apparatus of claim 15 wherein a toner image formed on the photosensitive body is transferred to an intermediate transfer body, and the toner image transferred to the intermediate transfer body is transferred to a recording medium conveyed from below to above, and when the one side is designated as a front side and the other side is designated as a rear side, and the rotary type developing device is disposed toward the front side with respect to a transfer position for transferring the toner image to the recording medium, and the intermediate transfer body is disposed therebetween.

20. The image forming apparatus of claim 15 wherein the image reading unit comprises a manuscript base, a reading member for reading a manuscript loaded on the manuscript base; and a scanning direction of the reading member is perpendicular to a moving direction of the center of gravity of the image reading unit.

* * * * *